US009915909B2

(12) United States Patent
Hiramatsu et al.

(10) Patent No.: US 9,915,909 B2
(45) Date of Patent: Mar. 13, 2018

(54) IMAGE FORMING APPARATUS

(71) Applicant: CANON KABUSHIKI KAISHA, Tokyo (JP)

(72) Inventors: Takashi Hiramatsu, Tokyo (JP); Motonari Ito, Suntou-gun (JP); Hideo Kihara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/260,619

(22) Filed: Sep. 9, 2016

(65) Prior Publication Data

US 2017/0075290 A1 Mar. 16, 2017

(30) Foreign Application Priority Data

Sep. 15, 2015 (JP) ..... 2015-181679
Jul. 13, 2016 (JP) ..... 2016-138467

(51) Int. Cl.
*G03G 21/00* (2006.01)

(52) U.S. Cl.
CPC ..... *G03G 21/0005* (2013.01); *G03G 21/0064* (2013.01)

(58) Field of Classification Search
CPC ..... G03G 21/0005
See application file for complete search history.

(56) References Cited

U.S. PATENT DOCUMENTS 4,674,865 A 6/1987 Tada et al.
6,954,609 B2 10/2005 Ito
6,996,356 B2 2/2006 Atsumi
2015/0132030 A1* 5/2015 Orihara ..... G03G 15/065 399/285
2016/0097986 A1 4/2016 Hiramatsu et al.

FOREIGN PATENT DOCUMENTS

JP S59-133573 A 7/1984
JP H06-308807 A 11/1994
JP H08-137361 A 5/1996
JP 3030188 B 4/2000
(Continued)

OTHER PUBLICATIONS

Office Action dated Mar. 7, 2017, in Japanese Patent Application No. 2016-138467.

*Primary Examiner* — David M Gray
*Assistant Examiner* — Michael Harrison
(74) *Attorney, Agent, or Firm* — Fitzpatrick, Cella, Harper & Scinto

(57) ABSTRACT

An image forming apparatus includes a control portion configured to perform a cleaning operation including: a first step of causing a developer, which has a reversed polarity and is attracted to a surface of a charging roller, to have a normal polarity under a state in which the developer bearing member is separated from the image bearing member with the contact/separation unit; and a second step of collecting the developer, which has the normal polarity and is attracted to the surface of the image bearing member, to the developer bearing member, by rotating the image bearing member and the developer bearing member under a state in which the developer bearing member is brought into contact with the image bearing member with the contact/separation unit after performing the first step.

39 Claims, 9 Drawing Sheets

(56) References Cited

FOREIGN PATENT DOCUMENTS

| | | | |
|---|---|---|---|
| JP | 2001-075448 | A | 3/2001 |
| JP | 2001-188405 | A | 7/2001 |
| JP | 2003-307914 | A | 10/2003 |
| JP | 2004-219855 | A | 8/2004 |
| JP | 2004-341193 | A | 12/2004 |
| JP | 2013-217987 | A | 10/2013 |
| JP | 2016-071296 | A | 5/2016 |

* cited by examiner

IMAGE FORMING APPARATUS

BACKGROUND OF THE INVENTION

Field of the Invention

The present invention relates to a cleanerless image forming apparatus. More particularly, the present invention relates to a so-called cleanerless type image forming apparatus, in which a developing device is configured to develop an image bearing member with toner, and to simultaneously clean a surface of the image bearing member after transfer by removing the toner remaining on the surface of the image bearing member to reuse the toner (simultaneous development and cleaning).

Description of the Related Art

In Japanese Patent Application Laid-Open No. 559-133573, there is disclosed a cleanerless type image forming apparatus, in which a developing means develops the photosensitive drum with toner and simultaneously cleans a surface of the photosensitive drum, removes and collects transfer residual toner remaining on the surface of the photosensitive drum to reuse the transfer residual toner (simultaneous development and cleaning). In this way, the toner remaining after transfer on the surface of the photosensitive drum does not become waste toner, thereby achieving environmental protection, effective use of resources, and apparatus downsizing.

In image forming apparatus employing a cleanerless system, a part of toner charged to an opposite polarity is attracted to a contact charging member to degrade charging performance of the contact charging member. According to Japanese Patent No. 3030188, toner that is charged to an opposite polarity and attracted to a contact charger is electrostatically attracted to a photosensitive member, reversed to have a normal polarity through slide friction with a developing roller, and collected to the developing roller.

Toner sometimes cannot be reversed to have a normal polarity through the slide friction with the developing roller depending on a use environment of an image forming apparatus and a state of a developing device serving as a developing means. Further, so-called fogging which causes toner to be transferred to a photosensitive drum as a result of contact between a developing device and the photosensitive drum often occurs. Particularly in a state with worsened fogging, attraction of toner to a charging roller occurs even through contact between the developing device and the photosensitive drum. The charging roller is also required to be cleaned at appropriate timings.

SUMMARY OF THE INVENTION

An object of the present invention is to provide an image forming apparatus, which is configured to collect a developer remaining on a surface of an image bearing member while simultaneously developing, in which the image forming apparatus is capable of collecting the developer attracted to a charging unit being in contact with the image bearing member. Another object of the present invention is to provide an image forming apparatus capable of cleaning a charging roller at appropriate timings.

Further, an object of the present invention is to provide an image forming apparatus, including: a rotatable image bearing member; a charging roller configured to charge a surface of the image bearing member through contact with the surface at a charging position; a developer bearing member configured to bear a developer and supply the developer having a normal polarity onto the surface of the image bearing member at a developing position when being in contact with the image bearing member, to form a developer image; a contact/separation unit configured to switch between a state in which the image bearing member and the developer bearing member are in contact with each other and a state in which the image bearing member and the developer bearing member are separated from each other; a transfer member configured to transfer the developer image to a transferred member at a transfer position; the developer bearing member capable of collecting the developer remaining on the surface of the image bearing member after transfer by using the transfer member; and a control portion configured to perform a cleaning operation for the charging roller that includes, a first step of causing the developer, which has a reversed polarity and is attracted to a surface of the charging roller, to have the normal polarity under a state in which the developer bearing member is separated from the image bearing member with the contact/separation unit, and a second step of collecting the developer, which has the normal polarity and is attracted to the surface of the image bearing member, to the developer bearing member, by rotating the image bearing member and the developer bearing member under a state in which the developer bearing member is brought into contact with the image bearing member with the contact/separation unit after performing the first step.

Further, another object of the present invention is to provide an image forming apparatus, including: a rotatable image bearing member; a charging roller configured to charge a surface of the image bearing member through contact with the surface at a charging position; a developer bearing member configured to bear a developer and supply the developer having a normal polarity onto the surface of the image bearing member at a developing position when being in contact with the image bearing member, to form a developer image; a contact/separation unit configured to switch between a state in which the image bearing member and the developer bearing member are in contact with each other and a state in which the image bearing member and the developer bearing member are separated from each other; a transfer member configured to transfer the developer image to a transferred member at a transfer position; the developer bearing member capable of collecting the developer remaining on the surface of the image bearing member after transfer by using the transfer member; and a control portion configured to perform, a first step of rotating the image bearing member and the charging roller with a rotational peripheral velocity difference therebetween under a state in which the developer bearing member is separated from the image bearing member by the contact/separation unit, and in which the charging roller has a potential on a normal polarity side of the developer than a potential of the image bearing member, and a second step of rotating the image bearing member and the developer bearing member under a state in which the developer bearing member is brought into contact with the image bearing member by the contact/separation unit, and in which the image bearing member has a potential on the normal polarity side of the developer than a potential of the developer bearing member.

Further, yet another object of the present invention is to provide an image forming apparatus, including: a rotatable image bearing member; a charging roller configured to charge a surface of the image bearing member through contact with the surface at a charging position; a developer bearing member configured to bear a developer and supply the developer having a normal polarity onto the surface of the image bearing member at a developing position when being in contact with the image bearing member, to form a developer image; a replaceable developer container configured to contain the developer to be supplied to the developer bearing member; a transfer member configured to transfer the developer image to a transferred member at a transfer position; the developer bearing member capable of collecting the developer remaining on the surface of the image bearing member after transfer by using the transfer member; and a control portion configured to perform a cleaning operation for the charging roller based on replacement of the developer container.

Further features of the present invention will become apparent from the following description of exemplary embodiments with reference to the attached drawings.

DESCRIPTION OF THE EMBODIMENTS

Now, embodiments for carrying out the present invention are described in detail in an illustrative manner based on examples with reference to the drawings. However, dimensions, materials, shapes, and relative positions of components described in the embodiments are to be modified as appropriate in accordance with a configuration of an apparatus to which the present invention is applied, or various conditions. Therefore, unless otherwise specifically described, the scope of the present invention is not intended to be limited thereto. The components in succeeding embodiments which are the same as those in the preceding embodiment are denoted by the same reference symbols as in the preceding embodiment so that description in the preceding embodiment will be applied.

First Embodiment

Overall Schematic Configuration of Image Forming Apparatus

Figure 1A:
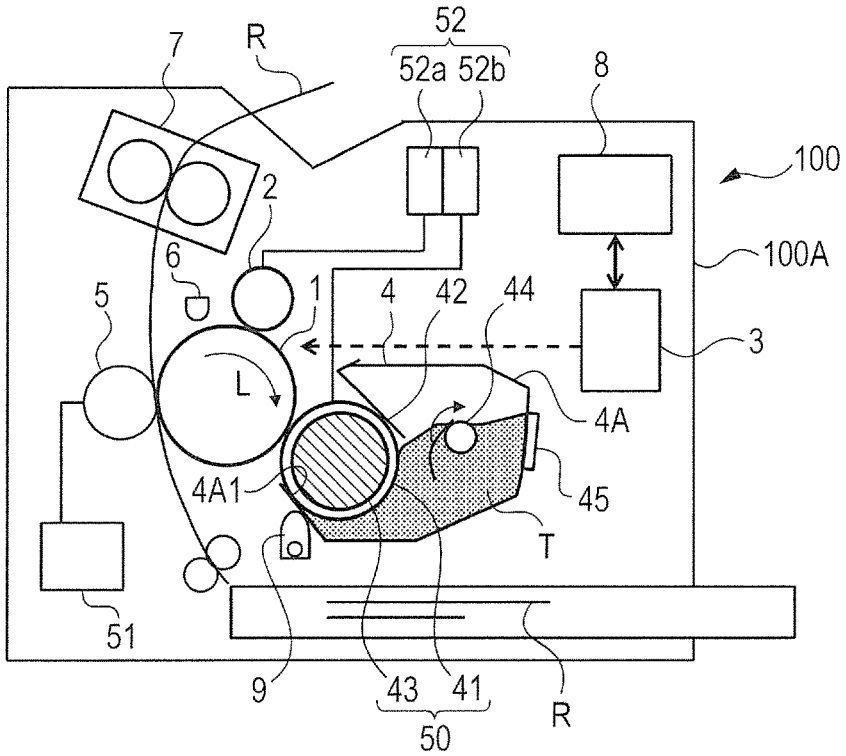
FIG. 1A and FIG. 1B are sectional views of an image forming apparatus.

FIG. 1A is a sectional view of an image forming apparatus 100 according to a first embodiment of the present invention. The image forming apparatus 100 includes an apparatus main body 100A. A photosensitive drum 1 serving as a rotatable image bearing member is arranged in the apparatus main body 100A. The photosensitive drum 1 is an OPC photosensitive member having an outer diameter of 20 mm and a negative polarity, and is driven to rotate at a constant peripheral speed of 166 mm/sec in a clockwise direction indicated by the arrow. A charging roller 2, a laser exposure unit 3, a developing device 4, and a transfer roller 5 are arranged around the photosensitive drum 1.

The charging roller 2 serving as a charging means is formed into a roller shape and is configured to be brought into contact with the photosensitive drum 1 to charge a surface of the photosensitive drum 1. The charging roller 2 is a conductive elastic roller, and includes a conductive elastic layer arranged around a metal core. The charging roller 2 is held in pressure contact with the photosensitive drum 1 under a predetermined pressing force. The charging roller 2 is driven to rotate with respect to rotation of the photosensitive drum 1. The charging roller 2 is associated with a charging power source 52*a*, which is configured to apply a charging bias. In this embodiment, the charging power source 52*a* applies a DC voltage to the metal core. A DC voltage of −1,300 V is applied as the charging bias. At that time, the photosensitive drum 1 is uniformly charged to a charge potential (dark part potential) of −700 V. When the charging bias is applied to the charging roller 2 as described above, an electric discharge occurs in a gap between the charging roller 2 and the photosensitive drum 1 to charge the surface of the photosensitive drum 1.

The laser exposure unit 3 serving as an exposure means is configured to expose the surface of the photosensitive drum 1 with light to form an electrostatic image. The laser exposure unit 3 uses a laser beam to repeat exposure of the photosensitive drum 1 with light in its main scanning direction (rotational axis direction of the photosensitive member) in accordance with image data. Simultaneously, the laser exposure unit 3 also performs exposure with light in a sub-scanning direction (surface moving direction of the photosensitive member) to form an electrostatic latent image. A laser power of the laser exposure unit 3 is adjusted so that the photosensitive drum 1 has an exposure potential (bright part potential) of −100 V upon exposure with light on an entire surface.

The developing apparatus (developing device) 4 serving as a developing means includes a developer container 4A. A developing roller 50 is rotatably supported on the developer container 4A. The developing roller 50 serving as a developer bearing member is configured to develop the electrostatic image formed on the surface of the photosensitive drum 1 with a developer through contact with the photosensitive drum 1. The developing apparatus (developing device) 4 contains magnetic toner T inside the developer container 4A. The magnetic toner is attracted to a developing sleeve 41 by a magnetic force of a magnetic roller 43 which is a magnetic field generating unit included in the developing sleeve 41. The developing sleeve 41 is associated with a developing power source 52*b*, which is configured to apply a developing bias and applies a DC voltage of −300 V as the developing bias.

The transfer roller 5 serving as a transfer means (contacting transfer unit) is configured to transfer a toner image serving as a developer image on the photosensitive drum 1 developed by the developing roller 50 onto a recording material R. The transfer roller 5 is brought into pressure contact with the photosensitive drum 1 at a predetermined pressure. The transfer roller 5 that is used in this embodiment includes a medium resistance foamed layer formed around the metal core, and has a roller resistance value of $5\times10^8\Omega$. Application of a voltage of +1,000 V causes the transfer roller 5 to transfer the toner onto the recording material R to be conveyed.

A pre-exposure portion 6 is arranged as a charge eliminating means before charging. The pre-exposure portion 6 is arranged on upstream of a charging position, where the charging roller 2 charges the photosensitive drum 1, in a moving direction L of the photosensitive drum 1. The pre-exposure portion 6 is configured to pre-expose the photosensitive drum 1 with light. A power of the pre-exposure portion 6 is set so that the photosensitive drum 1 has a smaller potential than the bright part potential. A fixing device 7 serving as a fixing means is configured to receive the recording material R having the toner image transferred thereon and to fix the toner image to the recording material R. The recording material R is delivered out of the apparatus main body 100A.

Figure 1B:
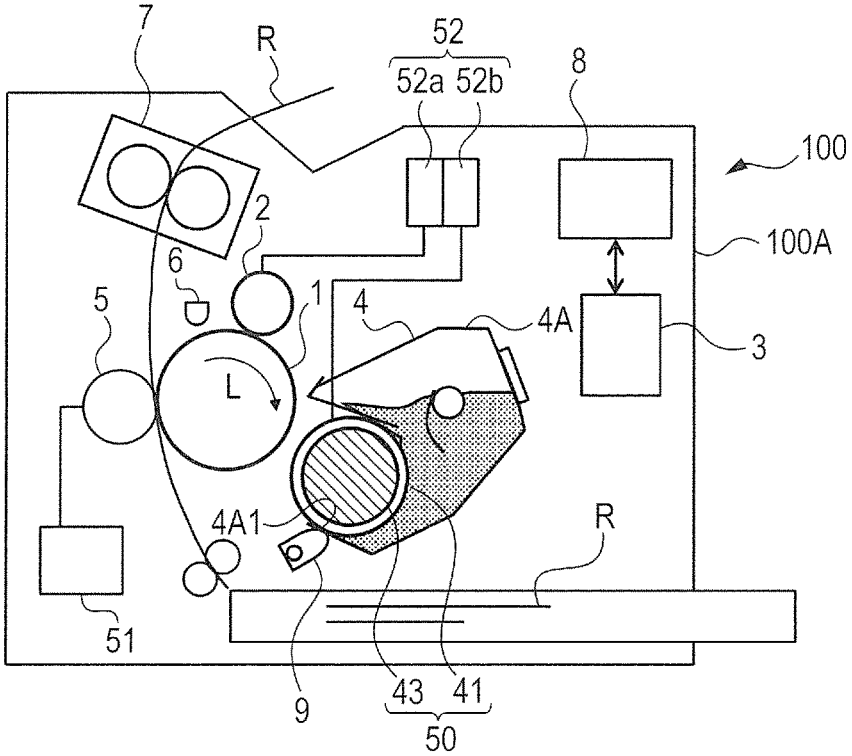

A control portion 8 is a unit, which is configured to control an operation of the image forming apparatus 100, controls transmission and reception of various electric information signals, and drive timings, and performs predetermined image forming sequence control. A contact/separation cam 9 (contact/separation mechanism for the developing device) serving as a contact/separation means is configured to cause the developing device 4 to be brought into contact with and separated from the photosensitive drum 1 through rotation. The developing roller 50 is thus brought into contact with and separated from the photosensitive drum 1. FIG. 1B is an illustration of a state in which the developing device 4 is separated from the photosensitive drum 1.

(Description of Developing Device)

The developing device 4 is described. The developing device 4 includes the developer container 4A. The developing roller 50 is rotatably arranged in an opening 4A1 of the developer container 4A. The developing roller includes the developing sleeve 41 and the magnetic roller 43. The developing sleeve 41 includes a conductive elastic rubber layer, which has a predetermined volume resistance, and is provided around a hollow non-magnetic metal (aluminum) tube. The magnetic roller 43 is arranged in a fixed state in the developing sleeve 41.

One-component magnetic black toner (negative charge characteristics) T serving as a developer in the developing device 4 is stirred by a stirring member 44 in the developer container 4A. The stirring causes the toner T to be supplied to a surface of the developing sleeve 41 under a magnetic force of the magnetic roller 43 in the developing device 4. The toner T supplied to the surface of the developing sleeve 41 passes on a developing blade 42 to be uniformly reduced in layer thickness and is charged to a negative polarity by triboelectric charging. Then, the toner T is conveyed to a developing position for contact with the photosensitive drum 1, thereby developing the electrostatic latent image.

Development of the electrostatic latent image is electrostatically performed based on a potential relationship between a potential of the latent image formed on the photosensitive drum 1 and the developing bias. The toner having negative charge characteristics is not attracted to the photosensitive drum 1 based on a potential relationship between the dark part potential (−700 V) in a non-image portion of the photosensitive drum 1 and the developing bias (−300 V). However, the toner has a distribution in charging polarity, and hence the toner having a positive polarity (reversed polarity) also partially exists. Therefore, although the amount is small, the toner T is also attracted to non-image portions on the photosensitive drum 1 as so-called fogging.

The charging polarity distribution of the toner T and its property of being negatively charged vary depending on a degradation in the condition of the toner T and the use environment of the image forming apparatus 100. Deterioration of the toner T lowers the negative charge property, and hence the amount of reversed polarity toner increases. Further, the charging property is also lowered in a high-temperature/high-humidity environment, and hence the polarity distribution of the toner T approaches a zero side to increase a ratio of the reversed polarity toner. As the amount of the reversed polarity toner becomes larger, the amount of fogging toner becomes larger.

A non-volatile memory 45 is mounted to the developing device 4. An amount of remaining toner and the number of rotations of the developing sleeve 41 as a use history of the developing device 4 are stored in the non-volatile memory 45. Writing on the non-volatile memory 45 is performed as needed through communication with the image forming apparatus 100, and the use history of the developing device 4 up to the present can be known even after the apparatus main body 100A is turned off.

(Cleanerless System)

A cleanerless system in image formation according to this embodiment is described below in detail. In this embodiment, there is employed a so-called cleanerless system in which a cleaning member is not arranged on upstream of the charging position of the charging roller 2 in the moving direction L (rotational direction) of the photosensitive drum 1. The cleaning member as referred to herein is a cleaning blade which comes into contact with the photosensitive drum 1 to scrape off toner on the surface of the photosensitive drum 1.

An electric discharge is generated by an electric field formed by a charging bias at a gap before a portion of contact (charging nip) between the charging roller 2 and the photosensitive drum 1. The transfer residual toner remaining on the photosensitive drum 1 after passed on the transfer roller 5 in a transfer step is charged by the electric discharge to the negative polarity which is the same as that of the photosensitive drum 1. The transfer residual toner charged to the negative polarity is not attracted to the charging roller 2 due to a potential relationship between the potential of the photosensitive member and the charging bias (surface potential of the photosensitive drum 1=−700 V, potential of the charging roller 2=−1,300 V), but passes through the charging nip.

The transfer residual toner having passed through the charging nip reaches a laser irradiation position along with rotation of the photosensitive drum 1. The amount of the transfer residual toner is not large enough to block out laser light from the laser exposure unit 3, and hence it does not affect a step of forming an electrostatic latent image on the photosensitive drum 1. After that, the transfer residual toner reaches a contact portion (abutment portion) between the developing sleeve 41 and the photosensitive drum 1 (developing nip).

Toner in unexposed portions (surface of the photosensitive drum 1 that is not exposed to laser irradiation) is electrostatically attracted to (collected by) the developing sleeve 31 due to the potential relationship between the dark part potential (−700 V) of the photosensitive drum 1 and the developing bias (−300 V). The toner that remains on the photosensitive drum 1 without being transferred onto the recording material R is collected to the developing device 4 in the unexposed portions. The toner collected to the developing device 4 is mixed with toner in the developing device 4 and used.

Toner in exposed portions (surface of the photosensitive drum 1 that is exposed to laser irradiation) remains as-is on the photosensitive drum 1 without being collected by the developing sleeve 41 due to the potential relationship between the bright part potential (−100 V) of the photosensitive drum 1 and the developing bias (−300 V). However, toner is electrostatically supplied from the developing roller 50 to the exposed portions.

In view of this, the image forming apparatus 100 performs, during image formation, simultaneous development and cleaning in which a developer remaining on the surface of the photosensitive drum 1 after transfer performed by the transfer roller 5 is collected to the developing roller 50 simultaneously with development.

In this embodiment, there are employed the following two configurations that allow the transfer residual toner to pass without being attracted to the charging roller 2. Firstly, the pre-exposure portion 6 serving as an optical charge eliminating member is arranged between the transfer roller 5 and the charging roller 2. In order to perform stable electric discharge at the charged portion, the pre-exposure portion 6 optically eliminates the surface potential of the photosensitive drum 1 before the charging roller 2. Optical charge elimination performed by the pre-exposure portion 6 allows a uniform electric discharge to be performed during charging, and the transfer residual toner can uniformly be caused to have the negative polarity which is the normal polarity, simultaneously.

Secondly, the charging roller 2 rotates with a predetermined velocity difference (peripheral velocity difference) set with respect to the photosensitive drum 1. The velocity difference set between the charging roller 2 and the photosensitive drum 1 is a feature of the simultaneous development and cleaning. In other words, the charging roller 2 has a velocity ratio of 1.1 set with respect to the photosensitive drum 1. The configuration of the pre-exposure portion 6 causes most of the toner to have the negative polarity when passing through the charging nip, but a small part of the toner remains without being changed to the negative polarity. When passing on the charging roller 2, the toner may be attracted under the influence of the electric field.

The reversed polarity toner that is attracted is rubbed by the peripheral velocity difference between the charging roller 2 and the photosensitive drum 1 to be reversed to the negative polarity which is the normal polarity. The toner can be attracted to the photosensitive drum 1 by being charged to the negative polarity. Attraction of the toner to the charging roller 2 is thus suppressed by the two configurations.

(Cleaning of Charging Roller)

The peripheral velocity difference is provided between the photosensitive drum 1 and the charging roller 2 to reverse the polarity through rubbing so that the toner has the negative polarity, and the toner is attracted to the photosensitive drum 1. However, a part of the toner does not have the reversed polarity, but continues to be attracted to the charging roller 2. When image formation is continued with the toner T attracted to the charging roller 2, the toner impedes charging to hinder uniform charging, thus degrading image quality. Then, it is necessary to perform cleaning of the charging roller (cleaning operation) for returning the toner T attracted to the charging roller 2 to the interior of the developing device 4 at predetermined timings.

The amount of the toner T attracted to the charging roller 2 depends on the amount of the toner on the photosensitive drum 1. When the developing roller 50 is held in contact with the photosensitive drum 1, the toner T supplied from the developing roller 50 to the photosensitive drum 1 includes toner to be fogged, thus generating a certain amount of fogging toner on the photosensitive drum 1. The amount of fogging toner is small in typical use, and hence the amount of fogging toner further attracted from the photosensitive drum 1 to the charging roller 2 is also small. However, when the amount of fogging toner is increased by deterioration of the toner or other causes, the amount of fogging toner further attracted from the photosensitive drum 1 to the charging roller 2 is also increased.

The charging roller 2 is not adequately cleaned when the charging roller 2 is cleaned under a state in which the developing roller 50 is held in contact with the photosensitive drum 1 and the amount of fogging toner is large.

According to this embodiment, the charging roller 2 is adequately cleaned even under a condition in which the amount of fogging toner supplied from the developing roller to the photosensitive drum 1 is easily increased. Therefore, during the cleaning, the developing roller 50 is separated from the photosensitive drum 1 to create a state in which the fogging toner is less liable to reach the photosensitive drum 1 from the developing roller 50. The fogging toner on the surface of the photosensitive drum 1 is removed to allow the charging roller 2 to be adequately cleaned.

Figure 2A:
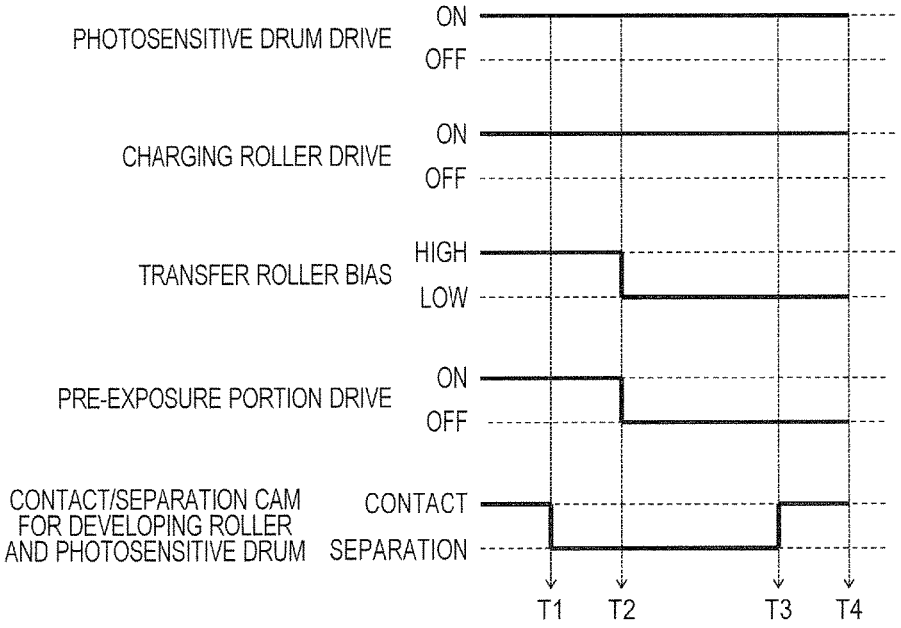
FIG. 2A is a timing chart for illustrating driving state timings of a photosensitive drum, a charging roller, a transfer roller, a pre-exposure portion, and a contact/separation cam.

FIG. 2A is a timing chart for illustrating driving state timings of the photosensitive drum 1, the charging roller 2, the transfer roller 5, the pre-exposure portion 6, and the contact/separation cam 9. With reference to FIG. 2A, an operation for cleaning the charging roller (cleaning operation) according to this embodiment is described. According to the present invention, the respective portions are controlled by the control portion 8 at the timings illustrated in FIG. 2A to perform the charging roller cleaning.

Figure 2B:
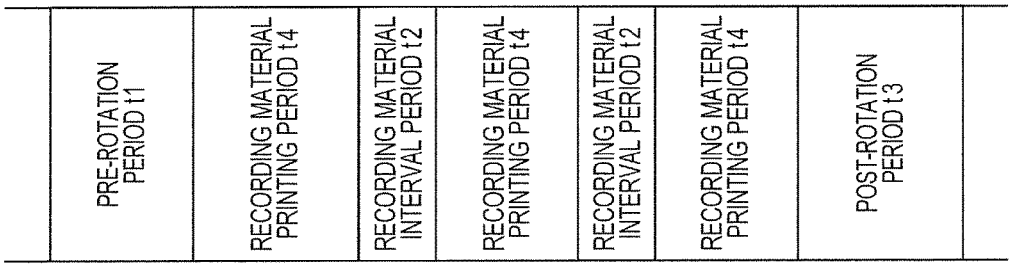
FIG. 2B is a view for illustrating non-image formation periods.

Non-image formation periods for cleaning the charging roller include a pre-rotation period t1, recording material interval periods t2, and a post-rotation period t3 as illustrated in FIG. 2B, and further a calibration period for density detection, and a period for a discharge operation of the toner T, and refers to at least periods when the photosensitive drum 1 rotates. Therefore, the non-image formation periods are periods other than image formation periods, and a period between a power-off of the image forming apparatus 100 and a subsequent power-on of the image forming apparatus 100 is excluded.

A series of operations which include changing the state of the developing roller 50 with respect to the photosensitive drum 1 from a contact state to a separated state, and then returning to the contact state are performed with the photosensitive drum 1 being in a driven state (ON) (i.e., those operations are performed while rotating the photosensitive drum 1). Further, the image formation period is a period when a toner image is formed on the photosensitive drum 1 with the toner T discharged from the developer container 4A, and is shown as the recording material printing period t4 in FIG. 2B.

First, as illustrated by the timing T1 in FIG. 2A, the control portion 8 rotates the contact/separation cam 9 to separate the developing device 4 from the photosensitive drum 1. The contact/separation cam 9 thus rotates during the non-image formation period to bring the developing roller 50 and the photosensitive drum to be shifted from the contact state to the separated state. This reduces the toner to be transferred from the developing roller 50 to the photosensitive drum 1 to enter the charging nip, thus allowing cleaning of the charging roller 2 to be performed next to be adequately performed.

Next, as illustrated by the timing T2 in FIG. 2A, bias of the transfer roller 5 is switched to turn off the pre-exposure portion 6. In transfer bias switching, the transfer bias is switched from +1,000 V (HIGH) applied during image formation to −1,100 V (LOW) which is the transfer bias during cleaning.

The transfer bias is changed to LOW so that the transfer bias (−1,100 V) is smaller than the surface potential (−700 V) of the photosensitive drum 1, thus eliminating a charge flow from the transfer roller 5 into the photosensitive drum 1. The charge flow from the transfer roller 5 is eliminated to allow the charge flow into the toner on the photosensitive drum 1 to be also eliminated, thus suppressing a tendency for the toner on the photosensitive drum 1 to have the positive polarity through the transfer bias. In other words, the transfer bias is changed to −1,100 V to prevent the toner on the surface of the photosensitive drum 1 from having a positive polarity. Further, in electric discharging onto the photosensitive drum 1, the toner on the photosensitive drum 1 has the negative polarity, but the toner attracted onto the charging roller 2 has the positive polarity.

A voltage switching portion 51 serving as a voltage switching means, which is configured to switch a voltage is connected to the transfer roller 5. Then, the voltage switching portion 51 increases at least the voltage to be applied to the transfer roller 5 on a developer polarity side above the potential of the photosensitive drum 1 when the developing roller 50, which has been contacted with the photosensitive drum 1 by the contact/separation cam 9, is in the separated state. In other words, the transfer bias is set on the developer polarity side (minus in this example) to be larger than the dark part potential of the photosensitive drum 1 (−700 V), as from +1,000 V to −1,100 V.

The toner of the charging roller 2 becomes positive in polarity, and hence the pre-exposure portion 6 is at least turned off to stop electric discharge from the charging roller 2 when the developing roller 50 is separated from the photosensitive drum 1 by the contact/separation cam 9. This suppresses the tendency for the toner on the charging roller 2 to have the positive polarity. Both suppress the tendency for the toner T to have the positive polarity to facilitate the subsequent cleaning of the charging roller 2 (in particular, collection of the toner transferred from the charging roller 2 to the photosensitive drum 1, which is performed by the developing roller 50). The control portion 8 causes the charging roller 2 to be cleaned between the timing T2 and the timing T3 in FIG. 2A. The cleaning of the charging roller 2 is performed by rubbing the charging roller 2 against the photosensitive drum 1.

The cleaning of the charging roller 2 is performed by rotating the charging roller 2 at least once after the portion on the photosensitive drum 1, from which the developing device 4 is separated, reaches the position of the charging roller 2. In other words, a separated surface X (see FIG. 2D), which is a surface of the photosensitive drum 1 that is brought into the separated state from the contact state with respect to the developing roller 50, arrives at the position of contact with the charging roller 2. Then, the separated state is provided for a period when the charging roller 2 is rotated at least once from the arrival. The separated surface X can be also referred to as a region of the photosensitive drum 1 that has passed on the developing roller 50 with the photosensitive drum being separated from the developing roller 50.

Figure 2C:
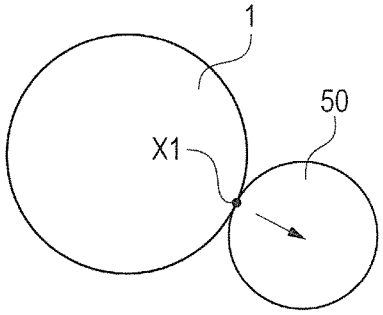
FIG. 2C is a sectional view of the photosensitive drum and a developing roller.
Figure 2D:
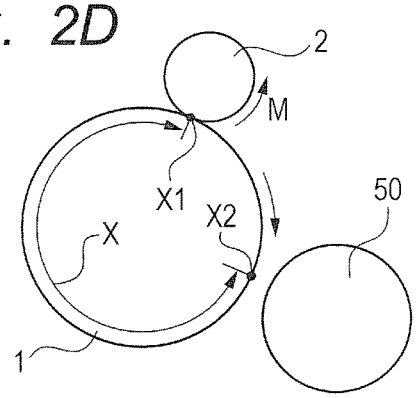
FIG. 2D is another sectional view of the photosensitive drum and the developing roller.

For example, it is assumed that a separation start position X1 where the photosensitive drum 1 and the developing roller 50 are shifted from the contact state to the separated state as in FIG. 2C is moved to the position of contact between the charging roller 2 and the photosensitive drum 1 as in FIG. 2D. With this, the separated surface X from the spacing start position X1 to a separated current position X2 is determined in the surface of the photosensitive drum 1. The charging roller 2 is set to rotate at least once in a direction indicated by the arrow M with the charging roller 2 opposed to the separated surface X.

The photosensitive drum 1 and the charging roller 2 rotate with a peripheral velocity difference therebetween, and hence the toner T on the charging roller 2 is rubbed to become negative in polarity and to be transferred to the photosensitive drum 1 with an electric field. Also at this time, the same voltage of −1,300 V as during image formation is applied to the charging roller 2. In other words, the potential of the charging roller 2 is set to be a potential on the normal polarity side (−) of the toner than the potential of the photosensitive drum 1.

The moving speed of the surface of the charging roller 2 is set to be 1.1 times as high as the moving speed of the surface of the photosensitive drum. In other words, the rotational speed of the charging roller 2 is higher than that of the photosensitive drum 1. As illustrated in FIG. 2D, the rotational direction of the charging roller 2 is set so that the moving direction of the surface of the photosensitive drum 1 is the same direction as the moving direction of the charging roller 2 in the portion of contact between the photosensitive drum 1 and the charging roller 2. In other words, the rotational direction of the photosensitive drum 1 is opposite to that of the charging roller 2.

In the series of cleaning operations, the state between the developing roller 50 and the photosensitive drum 1 is shifted from the contact state to the separated state, and is then shifted to the contact state. Operations during the series of cleaning operations are performed with the charging roller 2 being in the driven state (ON) (in other words, the operations are performed while rotating the charging roller 2 with the charging bias turned on). During the series of operations, when the charging bias of the charging roller 2 is turned off, the bias of the charging roller 2 is reversed with respect to the potential of the photosensitive drum 1, and the toner having the positive polarity is transferred to the photosensitive drum 1.

The toner having the positive polarity cannot be collected to the developing device 4 based on the relationship between the dark part potential (−700 V) of the photosensitive drum 1 and the developing bias (−300 V), and hence continues to be attracted to the photosensitive drum 1, which hinders cleaning. Therefore, during the series of operations, a potential difference between the potential (−1,300 V) of the charging roller 2 and the potential (−700 V) of the photosensitive drum 1 is set not to be reversed, and a voltage is applied to the charging roller 2. The potential of the charging roller 2 is thus set to be a potential on the normal polarity side (−) of the toner than the potential of the photosensitive drum 1. Further, the potential of the photosensitive drum 1 is set to be a potential on the normal polarity side (−) of the toner than the potential of the developing roller 50. According to this embodiment, a rubbing time when the charging roller 2 is rubbed against the photosensitive drum (cleaning time) is set to 1 sec.

The 1 sec corresponds to about six rotations in terms of the number of rotations of the charging roller 2. This is also experimentally determined in advance, and the toner is adequately transferred to the photosensitive drum when the charging roller 2 is rubbed about six times while rotating.

Figure 9:
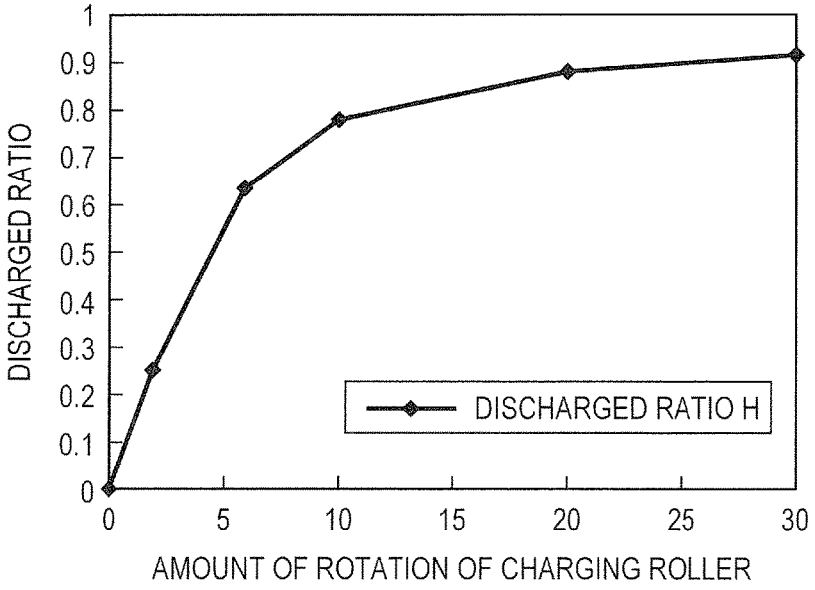
FIG. 9 is a graph for showing a relationship between an amount of rotation of the charging roller and a discharged ratio.

This is described below. FIG. 9 is a graph for showing a relationship between an amount of rotation of the charging roller 2 and a discharged ratio under a state in which the developing roller 50 is separated from the photosensitive drum 1. The amount of rotation of the charging roller 2 is the cumulative number of rotations of the charging roller 2 from the timing T2 as a starting point. The amount of rotation of the charging roller 2 is proportional to a rubbing period starting from the timing T2 during which the charging roller 2 is rubbed against the photosensitive drum 1. The discharged ratio is a parameter indicating to what extent the toner T attracted to the charging roller 2 is discharged (transferred) to the photosensitive drum 1. The discharged ratio is defined as Discharged ratio H: (amount of toner T discharged during n rotations of charging roller 2)/(amount of toner T attracted to charging roller 2). To be more specific, the discharged ratio can be calculated using an expression 1 shown below, by respectively measuring, a weight G1 of the charging roller 2 onto which the toner T is not attracted, a weight G2 of the charging roller 2 at the timing T2 onto which the toner T is attracted, and a weight G3 of the charging roller 2 after the n rotations.

$$H=(G2-G3)/(G2-G1) \quad \text{(Expression 1)}$$

As shown in FIG. 9, the amount of rotation of the charging roller and the discharged ratio have the following relationship: as the amount of rotation of the charging roller becomes larger, the discharged ratio becomes higher, because a large part of the toner is rubbed to have a negative polarity and is transferred to the photosensitive drum. It is experimentally found that occurrence of image failure may be rather reduced when the discharged ratio H is about 0.6 or more. Therefore, according to this embodiment, the amount of rotation of the charging roller 2 is set to six rotations at which the discharged ratio H reaches about 0.6. However, the rubbing time when the charging roller 2 is rubbed against the photosensitive drum 1 depends on a speed difference between the charging roller 2 and the photosensitive drum 1, and a state of attracted toner, and hence can be changed in accordance therewith.

After the cleaning is performed, the developing device 4 is brought into contact with the photosensitive drum 1 again by the contact/separation cam 9 to bring the developing roller 50 and the photosensitive drum 1 into contact with each other (timing T3 in FIG. 2A). When the state is shifted from the spaced state to the contact state, the developing roller 50 is at least brought into contact with the spaced surface X of the surface of the photosensitive drum 1 again.

The developing device 4 is brought into contact with the photosensitive drum 1 to make the developing sleeve 41 collect the negative polarity toner transferred to the photosensitive drum 1 during the cleaning (period between the timing T3 and the timing T4 in FIG. 2A). The time when the developing device 4 is brought into contact is set to 500 msec. This time is a time corresponding to one or more rotations of the photosensitive drum 1, because cleaning of the charging roller in the previous step is performed over the entire periphery of the photosensitive drum 1.

The operation of cleaning the charging roller is as described above. The charging roller 2 is cleaned with the developing device 4 separated therefrom and can be adequately cleaned even when the amount of fogging is large.

Based on the extent of attraction of the toner T to the charging roller 2, the control portion 8 determines whether or not the charging roller 2 is to be cleaned. The extent of attraction of the toner T to the charging roller 2 is experimentally determined in advance and is estimated by the use environment or use condition of the developing device 4. This is because a major part of the toner T attracted to the charging roller 2 depends on the amount of fogging toner, and because the amount of fogging toner depends on the use environment or the use condition of the developing device 4. Specifically, the control portion 8 performs a separating operation and a contacting operation depending on the use environment or the use condition.

In other words, as for the use environment, the period (number of printed sheets) before the cleaning of the charging roller 2 is performed is shortened (reduced) in high-temperature/high-humidity environment cases more than in normal environment cases. Further, as for the use condition, the period (number of printed sheets) before the cleaning of the charging roller 2 is performed is shortened (reduced) in cases where the toner T in the developing device 4 is degraded (cases where the coverage rate is low and the amount of remaining toner is small) more than in cases where the toner T is new. Accordingly, the control portion 8 causes the separating operation and the contacting operation to be performed more times as the use environment or the use condition is worse, and causes the separating operation or the contacting operation to be performed less times as the use environment or the use condition is better. Performance of the cleaning operation is thus determined based on the use environment or the use condition.

The cleaning of the charging roller 2 according to this embodiment is performed by rubbing the charging roller 2 against the photosensitive drum 1 (period between the timing T2 and the timing T3 in FIG. 2A), but the cleaning of the charging roller 2 is not limited thereto. For example, the cleaning may be performed by reversing the relation between the charging bias and the potential of the photosensitive drum 1 to transfer the positive polarity toner to the photosensitive drum 1, and reversing the transferred toner from the positive polarity to the negative polarity through electric discharge from the charging roller 2. Further, an electric discharge member (not shown) may be arranged at a portion facing the surface of the charging roller 2 to generate an electric discharge between the charging roller 2 and the electric discharge member. The positive polarity toner attracted onto the charging roller 2 may be thus reversed to have the negative polarity and transferred to the photosensitive drum 1.

The bias and the time on the charging roller cleaning are not necessarily limited to those in this embodiment. For example, the timing at which the transfer bias to be applied to the transfer roller 5 is switched from HIGH to LOW and the timing at which the pre-exposure portion 6 is switched from ON to OFF as indicated by the timing T2 in FIG. 2A may be set as follows. More specifically, the timings may precede the timing shown by the timing T1 in FIG. 2A at which the developing roller 50 is separated from the photosensitive drum 1. Further, the developing bias to be applied to the developing sleeve 41 when the developing roller 50 collects the toner on the surface of the photosensitive drum 1 again after the developing roller 50 is moved away from the photosensitive drum 1, can be determined in view of the collection of the toner T and the fogging.

A voltage applying portion 52 serving as a voltage applying means, which is configured to apply voltage to the developing roller 50 and the charging roller is arranged inside the apparatus main body 100A. The voltage applying portion 52 includes the charging power source 52*a* and the developing power source 52*b*. When the separated state is followed by the contact state again, at least one of a development application voltage to be applied to the developing roller 50 or a charge application voltage to be applied to the charging roller 2 is changed.

In other words, at the time of image formation, it is necessary to have a large potential difference for removal of fogging between the charge application voltage and the development application voltage. However, it is not necessary to have a large potential difference for the removal of fogging when the toner T is collected during cleaning at the time of non-image formation. Therefore, one of the charge application voltage and the development application voltage may be changed to reduce the potential difference for removal of fogging.

Second Embodiment

Figure 3:
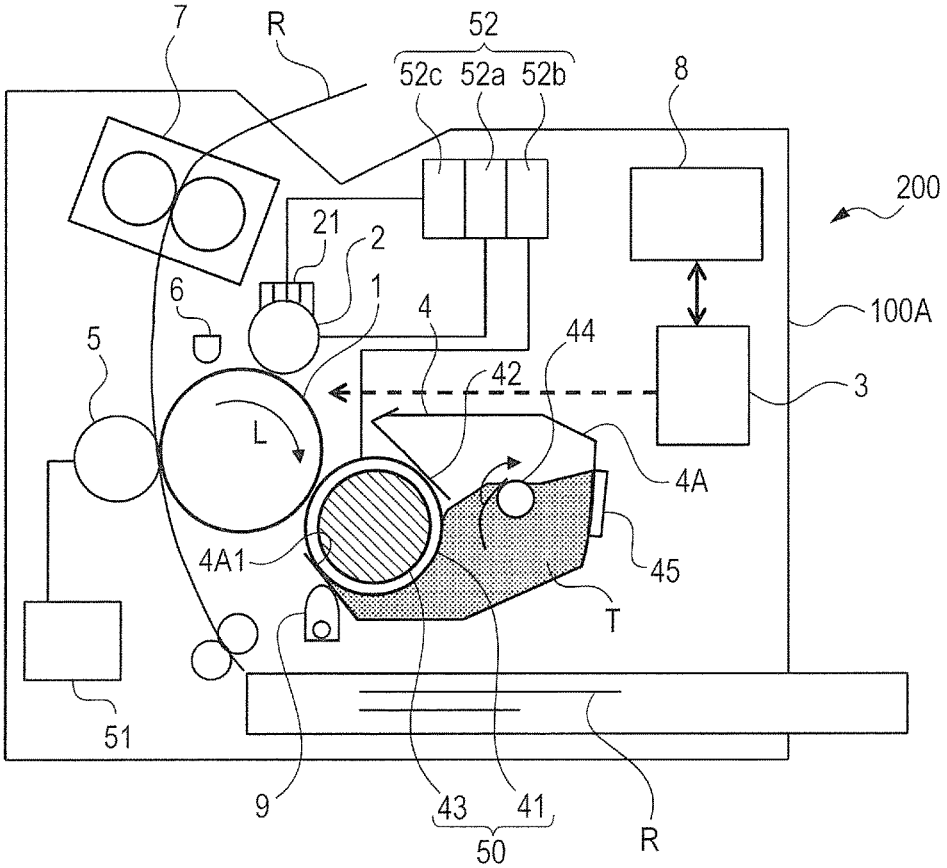
FIG. 3 is a sectional view of an image forming apparatus according to a second embodiment of the present invention.

FIG. 3 is a sectional view of an image forming apparatus 200 according to a second embodiment of the present invention. The image forming apparatus 200 according to the second embodiment is different from the image forming apparatus 100 according to the first embodiment in that a brush 21 (charge cleaning brush) is held in contact with the charging roller 2. In other words, the image forming apparatus 200 is different from the image forming apparatus 100 in that the former includes the brush 21 serving as a charge cleaning member, which is configured to clean the charging roller 2 through contact therewith.

The brush 21 is mounted to the apparatus main body 100A so that a predetermined pressure is applied to the charging roller 2. The brush 21 has a conductivity and a bias of the same potential as the charging roller 2 is applied.

(Brush 21)

Attraction of the toner T to the charging roller 2 which is a problem in a cleanerless type image forming apparatus is suppressed by providing the brush 21. A sheet-like member serving as a member for cleaning the charging roller may also be brought into pressure contact. However, when the sheet-like member is brought into pressure contact with the charging roller 2 for the purpose of cleaning the charging roller, a foreign matter such as paper dust is inserted between the sheet-like member and the charging roller 2. Then, desired cleaning performance is not achieved at that portion, thus causing charging unevenness.

Therefore, in this embodiment, there is employed the brush 21 as the member, which is configured to clean the charging roller 2. Further, the voltage applying portion 52 serving as the applying means applies a voltage of the same potential to the charging roller 2 and the brush 21. In other words, according to this embodiment, the voltage of the same potential as the charging roller 2 is applied to the brush 21 so that the toner on the charging roller 2 has the normal polarity through triboelectric charging. The voltage applying portion 52 according to this embodiment further includes a brush applying power source 52*c*, which is configured to apply a voltage to the brush 21.

When the portion of contact with the photosensitive drum 1 has been reached, the toner having the normal polarity on the charging roller 2 is electrostatically transferred to the photosensitive drum 1, and hence cleaning of the charging roller 2 is performed. From the viewpoint of cleaning properties of the charging roller 2, a potential difference may be provided between the brush 21 and the charging roller 2. At that time, it is suitable to apply a large voltage on the normal polarity side of the toner as the voltage to be applied to the brush 21.

(Brush Cleaning)

As image formation is continued, the toner T is accumulated on the brush 21. When the toner T is accumulated, performance for cleaning the charging roller 2 is reduced to increase the amount of toner attracted to the charging roller 2, thus causing an image failure due to the reduced charging performance. Then, it is necessary to clean the brush 21 to prevent the toner T from being accumulated on the brush 21. The toner T is accumulated on the brush 21 because the brush 21 scrapes off a part of the toner T attracted to the charging roller 2.

The scraped toner T (toner accumulated on the brush 21) is conveyed by rotation of the charging roller 2, subjected to triboelectric charging, and discharged to the charging roller 2. However, when a large amount of toner is attracted to the charging roller 2, the toner scraped off by the brush 21 is increased more than the toner discharged therefrom. Therefore, the amount of toner accumulated on the brush 21 is increased. When the amount of fogging toner is large, the toner attracted to the charging roller 2 is increased. Therefore, cleaning of the brush 21 is performed by eliminating the amount of toner attracted from the photosensitive drum 1 to the charging roller 2.

When the amount of the toner T attracted to the charging roller 2 is eliminated, the toner accumulated on the brush 21 is discharged to the charging roller 2. The toner T discharged to the charging roller 2 has the negative polarity, and hence, when reaching the portion of contact between the charging roller 2 and the photosensitive drum 1, is transferred to the photosensitive drum 1 by the action of an electric field. Even when the amount of fogging toner is large, cleaning of the brush can be thus performed.

Figure 4:
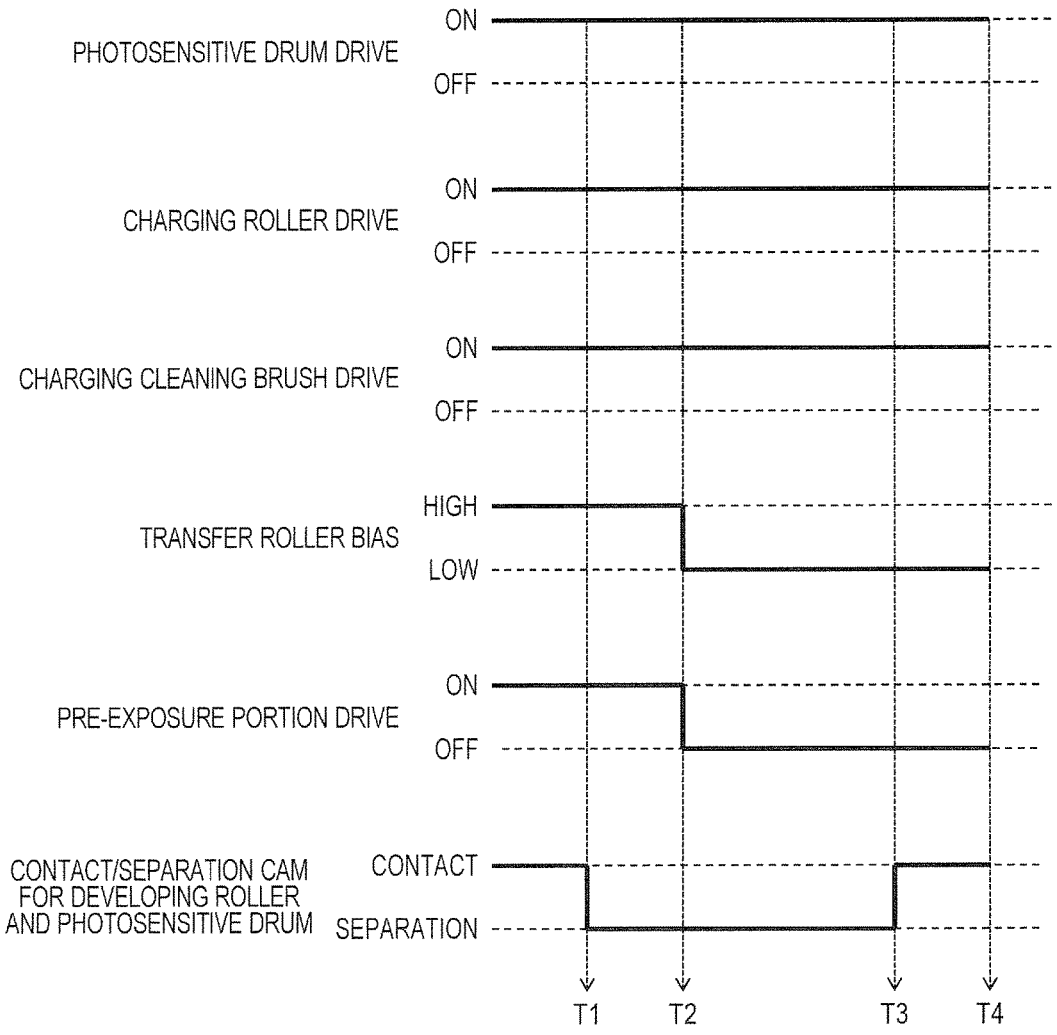
FIG. 4 is a timing chart for illustrating driving state timings of a photosensitive drum, a charging roller, a charging cleaning brush, a transfer roller, a pre-exposure portion, and a contact/separation cam.

An actual brush cleaning operation is illustrated in FIG. 4. The developing device 4 is separated (at timing T1 in FIG. 4) to eliminate the toner attracted from the photosensitive drum 1 to the charging roller 2. The charging roller 2 in the first embodiment has a cleaning time of about 1 sec. In contrast, in brush cleaning, the toner accumulated on the brush 21 is discharged to the charging roller 2 at low speed. Therefore, the photosensitive drum 1 is driven for about 8 sec (between the timing T2 and the timing T3 in FIG. 4).

This corresponds to about 50 rotations of the charging roller 2. Those rotations cause the toner T to be discharged from the brush 21 and cleaning is performed. Thereafter, the developing device 4 is brought into contact again (at timing T3 in FIG. 4) to collect the negative polarity toner transferred to the photosensitive drum 1.

A determination as to whether brush cleaning is to be performed depends on the extent of accumulation of the toner on the brush 21. The extent of accumulation of the toner T is determined by estimation, and whether brush cleaning is to be performed is determined depending on not only the use environment and the use history of the developing device 4, but also the number of continuously printed sheets and the cumulative number of printed sheets after a previous cleaning. Particularly when fogging is considerable, the toner T is more liable to be accumulated on the brush 21, and hence brush cleaning is performed upon use at high temperature/high humidity causing considerable fogging and in a situation in which the less amount of the toner T is in the developing device 4.

Also in this embodiment, the order and time of the cleaning operation is not necessarily limited thereto as with the charging roller cleaning in the first embodiment.

According to the configuration of the first embodiment or the second embodiment, the developing roller is moved away from the photosensitive drum 1 to eliminate attraction of the toner T to the charging roller 2 due to the fogging, and cleaning of the charging roller 2 is performed. After that, the developing roller 50 is brought into contact with the photosensitive drum 1 to allow the toner discharged through the cleaning to be collected to the developing device 4. As a result, in the image forming apparatus 100 and 200, which are configured to allow the toner T remaining on the surface of the photosensitive drum 1 to be collected to the developing roller 50 simultaneously with development, the toner T attracted to the charging roller 2, which is held in contact with the photosensitive drum 1 can be efficiently collected irrespective of the use environment or the use condition.

Third Embodiment

Figure 5:
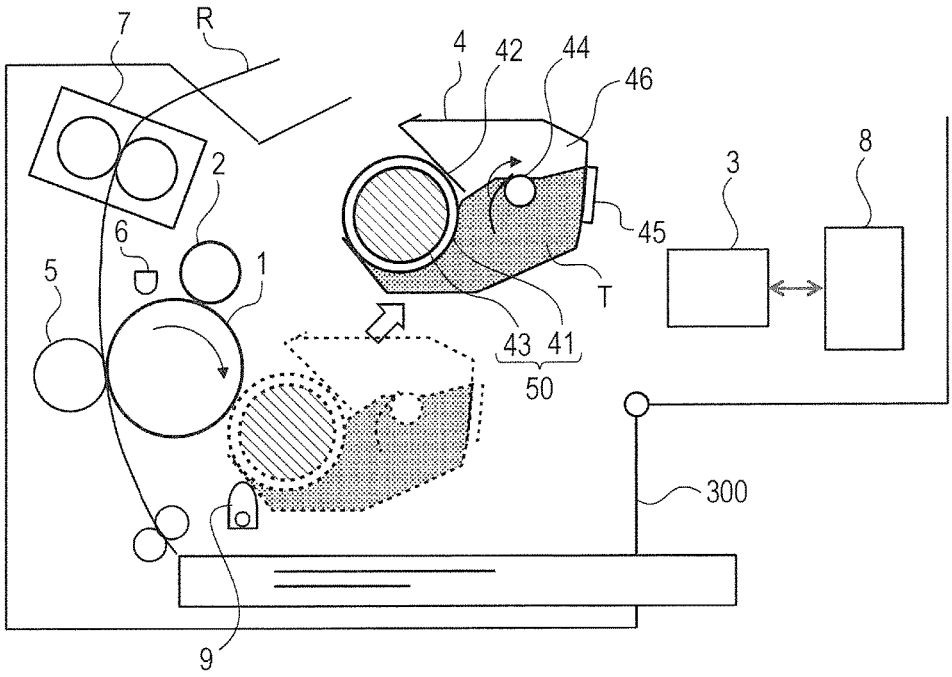
FIG. 5 is a sectional view of an image forming apparatus according to a third embodiment of the present invention.

FIG. 5 is a sectional view of an image forming apparatus 300 according to a third embodiment of the present invention. The image forming apparatus 300 according to the third embodiment is different from the image forming apparatus 100 according to the first embodiment in that the developing device 4 is replaceable.

(Description of Image Forming Apparatus Main Body)

A basic configuration is the same as the configuration described in the first embodiment. However, in the configuration according to this embodiment, the developing device 4 includes a toner container 46, which is configured to contain the toner T, and new toner T can be supplied to the image forming apparatus 300 through replacement of the developing device 4. The image forming apparatus 300 includes an openable and closable door. A user opens the door to remove the developing device 4 from the image forming apparatus 300 and to mount a new developing device 4. The image forming apparatus 300 reads information of the use history of the developing device 4 stored in the non-volatile memory 45 mounted to the developing device 4. The image forming apparatus 300 prompts the user to replace the developing device 4 when the amount of remaining toner or the cumulative number of rotations of the developing sleeve 41 reaches a predetermined threshold. This threshold is set to be within such a range of values of the cumulative number of rotations that may satisfy image quality at a predetermined level or higher. However, as compared to the developing device 4 which is new, the toner in the developing device 4 becomes relatively degraded as approaching the threshold, and hence fogging becomes also relatively worse. Therefore, under the state in which the threshold is almost reached, the amount of the toner T attracted to the charging roller 2 is more liable to be increased. Further, under the state in which the threshold is almost reached, also when the negative polarity toner is collected to the developing sleeve 41 during cleaning of the charging roller 2 (between the timing T3 and the timing T4 in FIG. 2A), the fogging toner is more liable to be attracted to the charging roller 2. Under such circumstances, even when the toner T is transferred from the charging roller 2 to the photosensitive drum 1, the toner T is attracted to the charging roller 2 again in a subsequent step. Therefore, cleaning becomes less effective. When the developing device 4 is replaced with a new developing device 4 without replacing the charging roller 2 under the state in which the toner is attached to the charging roller 2, the toner T still remains on the charging roller 2. Therefore, when image formation is performed without cleaning the charging roller 2, an image failure may occur after only a relatively small amount of image formation. In this embodiment, cleaning of the charging roller is performed at the time of replacement of the developing device 4.

(Operation of Cleaning of Charging Roller Upon Replacement of Developing Device)

Cleaning of the charging roller upon replacement of the developing device 4 is described with reference to a flowchart of FIG. 6. Determination of replacement of the developing device 4 is performed by the control portion 8. The non-volatile memory 45 stores not only the use history but also a serial number. A different serial number is assigned to each developing device 4, and numbers do not overlap each other. When the door of the image forming apparatus 300 is closed, the control portion 8 reads out information stored in the non-volatile memory 45 (Step S101). The control portion 8 compares information corresponding to a serial number already stored in the main body memory with information corresponding to a serial number read out from the non-volatile memory 45 (Step S102). This step S102 is performed before performing an operation of storing the information read out from the non-volatile memory 45 to the main body memory (not shown) arranged in the image forming apparatus 300. When those serial numbers are different from each other as a result of the comparison, the control portion 8 determines that the developing device 4 has been replaced and starts an operation of cleaning of the charging roller (Step S103). After the operation of cleaning of the charging roller is terminated, the control portion 8 causes the main body memory to store the information stored in the non-volatile memory 45. Printing is enabled after the operation of cleaning of the charging roller is terminated.

When the control portion 8 determines in Step S102 that the serial numbers are identical, cleaning of the charging roller is not performed, and the control portion 8 causes the main body memory to store the information stored in the non-volatile memory 45. After that, printing is enabled. The operation of cleaning of the charging roller is the same as that in the first embodiment. According to this embodiment, the control portion determines whether or not the developing device 4 has been replaced, based on a change in information corresponding to the serial number. However, information for the determination is not necessarily limited thereto. For example, the control portion 8 may determine that the developing device 4 has been replaced based on a change in information corresponding to the number of rotations of the developing sleeve 41 or the amount of remaining toner. Further, in a configuration in which the non-volatile memory 45 is not included, the operation of cleaning of the charging roller may always be performed at timings at which the door of the image forming apparatus 300 is opened and then closed. According to this embodiment, the charging roller can be cleaned at appropriate timings.

Fourth Embodiment

Figure 7:
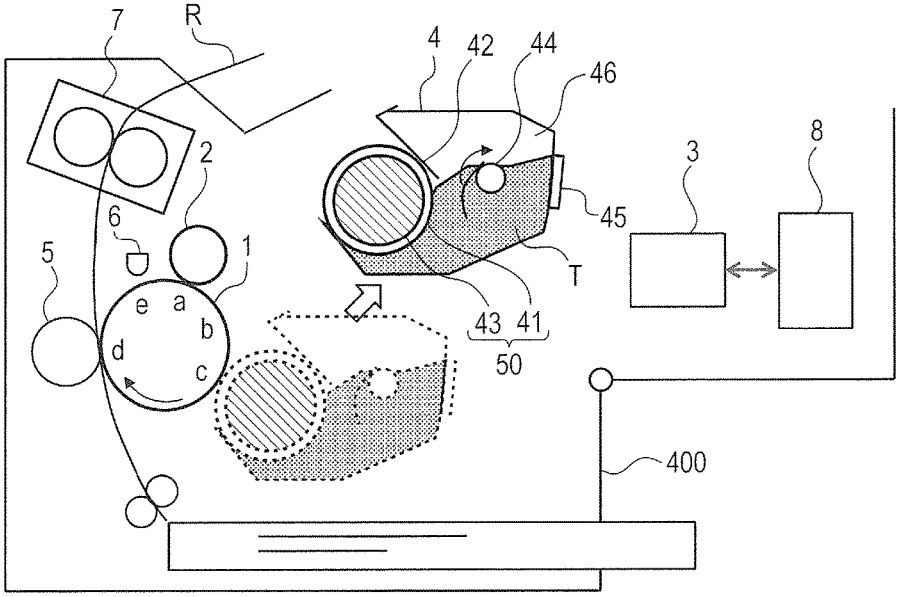
FIG. 7 is a sectional view of an image forming apparatus according to a fourth embodiment of the present invention.

Next, a fourth embodiment is described. This embodiment is the same as the third embodiment in timings at which the operation of cleaning of the charging roller is performed, but the operation of cleaning of the charging roller itself is different from that in the third embodiment. FIG. 7 is a sectional view of an image forming apparatus 400 according to the fourth embodiment of the present invention. The image forming apparatus 400 according to the fourth embodiment is different from the image forming apparatus 300 according to the third embodiment in that the image forming apparatus 400 does not have a contact/separation mechanism for the developing device. The contact/separation mechanism for the developing device is not included, and hence the configuration of the image forming apparatus main body can be simplified, thereby reducing cost. However, it is necessary to perform cleaning of the charging roller with an operation different from that in the third embodiment. A sequence for cleaning of the charging roller according to this embodiment is described below.

(Operation of Cleaning of Charging Roller Upon Replacement of Developing Device)

According to this embodiment, the toner attracted to the charging roller 2 and charged to the positive polarity is attracted to the photosensitive drum 1 electrostatically (with an electric field) with the toner being charged to the positive polarity. In other words, the voltage to be applied to the charging roller 2 is set to a voltage on the positive polarity side with respect to the surface potential of the photosensitive drum 1. In this way, the toner is electrostatically attracted from the charging roller 2 to the photosensitive drum 1 while being charged to the positive polarity. Then, the toner attracted to the photosensitive drum 1 and charged to the positive polarity is hardly collected to the developing device 4 at a developing portion c due to a potential difference and passes through the developing portion c. After that, a region of the photosensitive drum 1, to which the toner charged to the positive polarity is attracted, is subjected to charging through discharge from the charging roller 2. Further, the charging polarity of the toner charged to the positive polarity is reversed to the negative polarity. At that time, according to this embodiment, the region of the photosensitive drum 1, to which the toner charged to the positive polarity is attracted, is subjected to charging by using the charging roller 2 after optical charge elimination is performed by the pre-exposure device 6. Then, the toner charged to the negative polarity passes through a charging portion a and is thereafter electrostatically transferred to the developing sleeve 41 at the developing portion c and collected by the developing device 4. This control is performed by the control portion 8.

Figure 8:
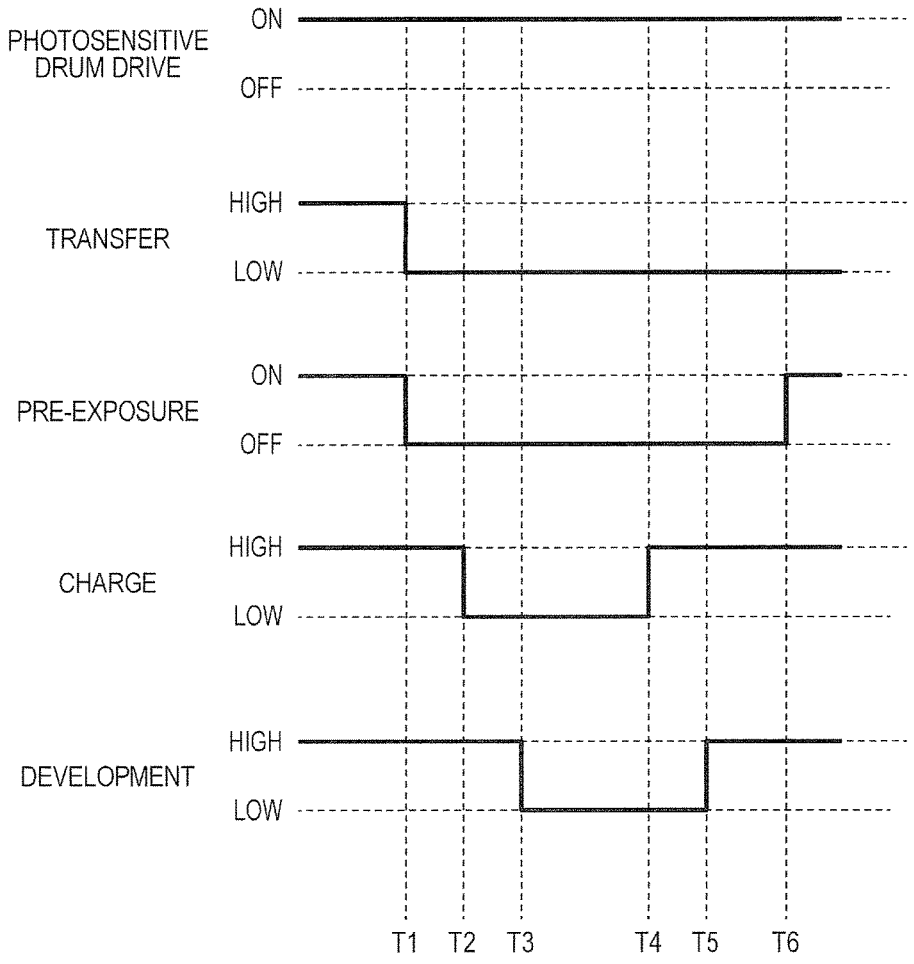
FIG. 8 is a timing chart for illustrating driving state timings of a photosensitive drum, a transfer roller, the pre-exposure portion, a charging roller, and a developing roller.

FIG. 8 is a timing chart of the operation of cleaning of the charging roller according to this embodiment. Subsequently to a preceding multi-rotation operation performed upon mounting of the developing device on the image forming apparatus 400, the operation of cleaning of the charging roller is performed by controlling the operations of the respective portions at timings shown in FIG. 8. During the preceding multi-rotation operation, the charging bias, the developing bias, and the transfer bias, which are each the same bias (HIGH) as during image formation, is applied to perform drum driving with the pre-exposure being in an on state.

[Timing 1 (T1)]

When the preceding multi-rotation is terminated, the transfer bias is changed from +1,000 V (HIGH) to −1,100 V (LOW). The transfer bias is changed to LOW to stop a charge flow from the transfer roller 5 to thereby suppress a decrease in the surface potential of the photosensitive drum 1 after having passed through a transfer portion d. In addition, the pre-exposure device 6 is turned off to suppress a decrease in surface potential of the photosensitive drum 1 due to optical charge elimination before reaching the charging portion a. The transfer bias is thus set to LOW, and the pre-exposure device 6 is turned off, thereby maintaining the charge potential of the photosensitive drum 1. After the preceding multi-rotation is terminated, the charging bias and the developing bias remain HIGH. In other words, a predetermined charge voltage is applied to the charging roller 2 to charge the photosensitive drum 1. Further, a predetermined developing voltage is applied to the developing sleeve 41 when the charged region of the photosensitive drum 1 passes through the developing portion c (Step T1).

[Timing 2 (T2)]

Next, the region of the photosensitive drum 1, which has passed through the transfer portion d with the transfer bias in a LOW state and passed through the charge eliminating portion e with the pre-exposure device 6 in an OFF state, reaches the charging portion a. Then, the charging bias is changed from −1,400 V (HIGH) to 0 V (LOW). With this, the charging bias becomes a voltage which is higher on the positive polarity side than the surface potential (−800 V) of the photosensitive drum 1. At that time, the LOW charging bias to be applied to the charging roller 2 is such that the potential difference between the photosensitive drum 1 and the charging roller 2 at the charging portion a is equal to or higher than a discharge start voltage Vth. Therefore, back discharge from the photosensitive drum 1 to the charging roller 2 occurs to reduce the surface potential of the photosensitive drum 1 to about −600 V, thus having a smaller absolute value. In other words, the photosensitive drum 1 passes through the charging portion a to cause the surface potential of the photosensitive drum 1 to have a smaller absolute value than that immediately before reaching the charging portion a. Then, the toner attracted to the charging roller 2 and charged to the positive polarity is electrostatically attracted to the photosensitive drum 1 with the toner being charged to the positive polarity. Further, a small amount of toner on the charging roller 2 having no polarity is charged to the negative polarity through back discharge from the photosensitive drum 1 to the charging roller 2. In other words, when the region of the photosensitive drum charged after the Step T1 passes through the charging portion a, the voltage to be applied to the charging roller 2 is changed to such a voltage that has a higher potential on the positive polarity side than the surface potential when the region reaches the charging portion a (Step T2).

[Timing 3 (T3)]

Next, the region of the photosensitive drum 1, which has passed through the charging portion a with the charging bias in a LOW state, reaches the developing portion c. Then, the developing bias is changed from −500 V (HIGH) to V (LOW). In other words, the above-mentioned back discharge causes the absolute value of the surface potential of the photosensitive drum 1 to decrease. Therefore, the developing bias is correspondingly changed to LOW so that the developing bias voltage is higher on the positive polarity side than the surface potential of the photosensitive drum 1 (for example, voltage which has a small absolute value and is identical in polarity to the surface potential of the photosensitive drum 1). When the developing bias is changed to LOW, a major part of the toner on the photosensitive drum 1 charged to the positive polarity passes through the developing portion c under a state in which the toner is electrostatically urged from the developing sleeve 41 toward the photosensitive drum 1. At that time, a part of the toner on the photosensitive drum 1 charged to the positive polarity may be collected by the developing apparatus 4. In other words, when the region of the photosensitive drum having passed through the charging portion a during voltage application to the charging roller after the Step T2 passes through the developing portion c, the voltage to be applied to the developing sleeve is changed to a voltage which is higher on the positive polarity side than the predetermined developing voltage (Step T3).

[Timing 4 (T4)]

Next, the charging bias is returned to HIGH after at least one rotation of the charging roller 2 with the charging bias in the LOW state. The charging bias voltage is set higher on the negative polarity side with respect to the surface potential of the photosensitive drum 1 (to be identical in polarity and larger in absolute value). A small amount of toner charged to the negative polarity and remaining on the charging roller 2 through application of the LOW charging bias is electrostatically attracted to the photosensitive drum 1. The timing for returning the charging bias from LOW to HIGH can be set to after at least one rotation of the charging roller 2 from the charging so as to allow the entire periphery of the charging roller 2 to be cleaned. Further, the cleaning operation for the charging roller 2 is not prolonged more than necessary. Therefore, the charging bias can be returned from LOW to HIGH at a timing at which the region of the photosensitive drum 1 which has passed through the charging portion a with the charging bias in the LOW state reaches the charging portion a after one rotation of the photosensitive drum 1. However, the timing at which the charging bias is returned from LOW to HIGH may be after more than one rotation of the photosensitive drum 1. The HIGH charging bias after the change is not limited to the voltage before being changed to LOW, but any voltage is applicable as long as a potential difference necessary to attract the toner remaining on the charging roller 2 and charged to the negative polarity to the photosensitive drum 1 can be generated. In other words, when the region of the photosensitive drum 1 having passed through the charging portion a during voltage application to the charging roller 2 after the Step T2 passes through the charging portion a, the voltage to be applied to the charging roller 2 is changed to a voltage which is higher on the normal polarity side than the voltage after the change in the Step T2 (Step T4).

[Timing 5 (T5)]

Next, the region of the photosensitive drum 1, which has passed through the charging portion a with the charging bias in the LOW state, passed through the developing portion c, and the region of the photosensitive drum 1, which has passed through the charging portion a again with the charging bias returned to HIGH, reaches the developing portion c. Then, the developing bias is returned to HIGH. The region of the photosensitive drum 1, which has passed through the charging portion a with the charging bias in the LOW state, is a region of the photosensitive drum 1 where the surface potential is reduced in the absolute value. Further, the region of the photosensitive drum 1, which has passed through the charging portion a with the charging bias returned to HIGH, is a charge potential region of the photosensitive drum 1 during normal image formation according to this embodiment. The timing for returning this developing bias from LOW to HIGH can be changed in accordance with the timing for returning the charging bias from LOW to HIGH. In other words, when the region of the photosensitive drum 1 having passed through the charging portion a during voltage application to the charging roller 2 after the Step T3 passes through the developing portion c, the voltage to be applied to the developing sleeve 41 is changed to a voltage which is higher on the normal polarity side than the voltage after the Step T3 (Step T5).

[Timing 6 (T6)]

Next, when the region of the photosensitive drum 1 having passed through the charging portion a with the charging bias in the LOW state reaches the charge eliminating portion e, the pre-exposure device 6 is turned on. In other words, the region of the photosensitive drum having passed through the charging portion a with the charging bias in the LOW state is a region to which the toner charged to the positive polarity is attracted from the charging roller 2. Before this region enters the charging portion a again, this region is subjected to optical charge elimination with the pre-exposure device 6. The pre-exposure device 6 is turned on to cause the surface potential of the photosensitive drum 1 entering the charging portion a to have a smaller absolute value to facilitate discharge from the charging device 2 to the photosensitive drum 1. The charging polarity of the toner attracted onto the photosensitive drum 1 and charged to the positive polarity is adequately reversed to the negative polarity. The toner charged to the normal polarity, that is, negative polarity passes through the charging portion a under a state in which the toner is electrostatically urged from the charging roller 2 toward the photosensitive drum 1. After that, the toner charged to the negative polarity is electrostatically transferred to the developing sleeve 41 at the developing portion c and collected by the developing device 4. In other words, when the region of the photosensitive drum 1 which should pass through the charging portion a during voltage application to the charging roller 2 after the Step T4 passes through the charge eliminating portion e, the pre-exposure device 6 is allowed to perform charge elimination of the photosensitive drum 1.

As described above, according to this embodiment, the toner charged to a polarity opposite to a normal polarity and attracted from the charging roller 2 to the photosensitive drum 1 in the operation of cleaning of the charging roller 2 can be adequately charged to the normal polarity, transferred to the developing sleeve 41, and collected to the developing apparatus 4. According to this embodiment, the charging polarity of the toner charged to the polarity opposite to the normal polarity is reversed to the normal polarity through stable discharge at the charging portion a. Therefore, the charging polarity can be adequately reversed irrespective of the use environment or the use conditions such as settings of the developing apparatus.

According to this embodiment, the period during which the charging bias is in the LOW state is set to 300 msec which is a time period corresponding to one or more rotations of the charging roller 2 (less than one rotation of the photosensitive drum 1). However, the period is not limited thereto. It is also possible to rotate the charging roller 2 by a plurality of times with the charging bias being in the LOW state (the number of rotations may correspond to one or more rotations of the photosensitive drum 1). It is also possible to repeatedly change the charging bias between the LOW state and the HIGH state. In this case, it is only necessary that the developing bias be repeatedly changed between the LOW state and the HIGH state in correspondence with the charging bias. Further, the timing T1 through the timing T6 shown in FIG. 8 are not necessarily set in this order. For example, the timing at which the transfer bias is changed to LOW and the timing at which the pre-exposure is turned off may not be simultaneous, and any one of the timings may precede. Further, as for the timing at which the charging bias is changed to LOW and the timing at which the developing bias is changed to LOW, any one of the timings may precede, or the timings may be simultaneous.

Figure 6:
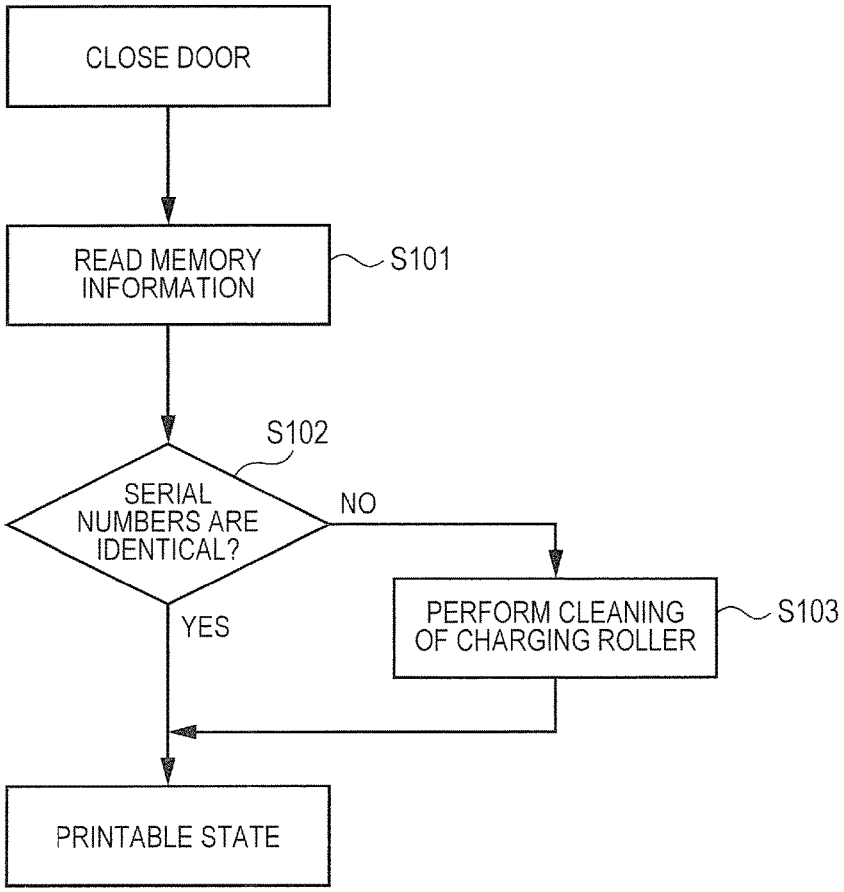
FIG. 6 is a flowchart for determination of whether a developing apparatus has been replaced.

The timing at which the operation of cleaning of the charging roller upon the replacement of the developing device is the same as that in the third embodiment, and the cleaning operation is performed when it is determined that the developing device 4 has been replaced, as shown in the flowchart in FIG. 6.

According to this embodiment, a description is given by using the image forming apparatus 400 which does not include the contact/separation mechanism for the developing device. However, the operation of cleaning of the charging roller according to this embodiment can also be performed in the image forming apparatus 100, 200 and 300 described in the first to third embodiments, each having the contact/separation mechanism for the developing device.

According to this embodiment, the charging roller can be cleaned at appropriate timings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-181679, filed Sep. 15, 2015, and Japanese Patent Application No. 2016-138467, filed Jul. 13, 2016, which are hereby incorporated by reference herein in their entirety.

What is claimed is:

1. An image forming apparatus, comprising:

a rotatable image bearing member;

a charging roller configured to charge a surface of the image bearing member through contact with the surface at a charging position;

a developer bearing member configured to bear a developer and supply the developer having a normal polarity onto the surface of the image bearing member at a developing position when being in contact with the image bearing member, to form a developer image;

a contact/separation unit configured to switch between a state in which the image bearing member and the developer bearing member are in contact with each other and a state in which the image bearing member and the developer bearing member are separated from each other;

a transfer member configured to transfer the developer image to a transferred member at a transfer position, the developer bearing member being capable of collecting the developer remaining on the surface of the image bearing member after transfer by using the transfer member; and a control portion configured to perform a cleaning operation for the charging roller that includes (i) a first step of causing the developer, which has a reversed polarity and is attracted to a surface of the charging roller, to have the normal polarity under a state in which the developer bearing member is separated from the image bearing member with the contact/separation unit, and (ii) a second step of collecting the developer, which has the normal polarity and is attracted to the surface of the image bearing member, to the developer bearing member, by rotating the image bearing member and the developer bearing member under a state in which the developer bearing member is brought into contact with the image bearing member with the contact/separation unit after performing the first step.

2. An image forming apparatus according to claim 1, wherein, when the first step is being performed, a voltage, which is larger on a normal polarity side of the developer than a potential of the image bearing member, is applied to the charging roller.

3. An image forming apparatus according to claim 1, wherein, when the second step is being performed, a voltage, which is larger on a reversed polarity side of the developer than a potential of the image bearing member, is applied to the developer bearing member.

4. An image forming apparatus according to claim 1, wherein, in the first step, the image bearing member and the charging roller are rotated with a rotational peripheral velocity difference therebetween to cause the developer of the reversed polarity attracted to the surface of the charging roller to have the normal polarity.

5. An image forming apparatus according to claim 1, further comprising an exposure unit configured to expose the image bearing member with light upstream of the charging position and downstream of the transfer position in a moving direction of the surface of the image bearing member, wherein the exposure unit is turned off when the first step is being performed.

6. An image forming apparatus according to claim 1, wherein, when the second step is being performed, a voltage, which is larger on a normal polarity side of the developer than a potential of the image bearing member, is applied to the charging roller.

7. An image forming apparatus according to claim 1, wherein, when the first step is being performed, a voltage, which is larger on a normal polarity side of the developer than a potential of the image bearing member, is applied to the transfer member.

8. An image forming apparatus according to claim 1, wherein the first step and the second step are performed based on at least one of a use environment or a use amount of the image forming apparatus.

9. An image forming apparatus according to claim 1, further comprising a charge cleaning member configured to be brought into contact with the charging roller to remove an object attracted to the surface of the charging roller.

10. An image forming apparatus according to claim 9, wherein the charge cleaning member is a brush.

11. An image forming apparatus according to claim 9, wherein the charge cleaning member has an electrical conductivity, and wherein the charging roller and the charge cleaning member receive application of a voltage at the same potential.

12. An image forming apparatus according to claim 1, wherein the first step and the second step are performed during a non-image formation period, the non-image formation period being a period other than an image formation period during which the developer image is formed on the image bearing member with the developer, which is borne on the developer bearing member, and is transferred to the transferred member.

13. An image forming apparatus according to claim 12, wherein a difference between a voltage applied to the charging roller and a voltage applied to the developer bearing member in the second step is smaller than a difference between a voltage applied to the charging roller and a voltage applied to the developer bearing member during the image formation period.

14. An image forming apparatus according to claim 4, wherein, when the first step is being performed, a direction of rotation of the image bearing member is opposite to a direction of rotation of the charging roller.

15. An image forming apparatus according to claim 14, wherein, when the first step is being performed, a rotational peripheral velocity of the charging roller is higher than a rotational peripheral velocity of the image bearing member.

16. An image forming apparatus according to claim 1, further comprising a replaceable developer container configured to contain the developer to be supplied to the developer bearing member, wherein the control portion is configured to perform the first step and the second step based on replacement of the developer container.

17. An image forming apparatus, comprising:

a rotatable image bearing member;

a charging roller configured to charge a surface of the image bearing member through contact with the surface at a charging position;

a developer bearing member configured to bear a developer and supply the developer having a normal polarity onto the surface of the image bearing member at a developing position when being in contact with the image bearing member, to form a developer image;

a contact/separation unit configured to switch between a state in which the image bearing member and the developer bearing member are in contact with each other and a state in which the image bearing member and the developer bearing member are separated from each other;

a transfer member configured to transfer the developer image to a transferred member at a transfer position, the developer bearing member being capable of collecting the developer remaining on the surface of the image bearing member after transfer by using the transfer member; and a control portion configured to perform (i) a first step of rotating the image bearing member and the charging roller with a rotational peripheral velocity difference therebetween under a state in which the developer bearing member is separated from the image bearing member by the contact/separation unit, and in which the charging roller has a potential on a normal polarity side of the developer relative to a potential of the image bearing member, and (ii) a second step of rotating the image bearing member and the developer bearing member under a state in which the developer bearing member is brought into contact with the image bearing member by the contact/separation unit, and in which the image bearing member has a potential on the normal polarity side of the developer relative to a potential of the developer bearing member.

18. An image forming apparatus according to claim 17, wherein, when the first step is performed, the contact/separation unit causes the developer bearing member being in contact with the image bearing member to be separated from the image bearing member, and wherein, in the first step, the charging roller is rotated by at least one rotation under a state in which the charging roller is held in contact with a spaced region, the spaced region being a region of the surface of the image bearing member which passes through an opposed position of the developer bearing member without being in contact with the developer bearing member when the first step is being performed.

19. An image forming apparatus according to claim 18, wherein, in the second step, the developer bearing member is held in contact with the spaced region during rotation.

20. An image forming apparatus according to claim 17, further comprising an exposure unit configured to expose the image bearing member with light upstream of the charging position and downstream of the transfer position in a moving direction of the surface of the image bearing member, wherein the exposure unit is turned off when the first step is being performed.

21. An image forming apparatus according to claim 17, wherein, when the second step is being performed, a voltage, which is larger on a normal polarity side of the developer than a potential of the image bearing member, is applied to the charging roller.

22. An image forming apparatus according to claim 17, wherein, when the first step is being performed, a voltage, which is larger on a normal polarity side of the developer than a potential of the image bearing member, is applied to the transfer member.

23. An image forming apparatus according to claim 17, wherein the first step and the second step are performed based on at least one of a use environment or a use amount of the image forming apparatus.

24. An image forming apparatus according to claim 17, further comprising a charge cleaning member configured to be brought into contact with the charging roller to remove an object attracted to the surface of the charging roller.

25. An image forming apparatus according to claim 24, wherein the charge cleaning member is a brush.

26. An image forming apparatus according to claim 24, wherein the charge cleaning member has an electrical conductivity, and wherein the charging roller and the charge cleaning member receive application of a voltage at the same potential.

27. An image forming apparatus according to claim 17, wherein the first step and the second step are performed during a non-image formation period, the non-image formation period being a period other than an image formation period during which the developer image is formed on the image bearing member with the developer, which is borne on the developer bearing member, and is transferred to the transferred member.

28. An image forming apparatus according to claim 27, wherein a difference between a voltage applied to the charging roller and a voltage applied to the developer bearing member in the second step is smaller than a difference between a voltage applied to the charging roller and a voltage applied to the developer bearing member during the image formation period.

29. An image forming apparatus according to claim 17, wherein, when the first step is being performed, a direction of rotation of the image bearing member is opposite to a direction of rotation of the charging roller.

30. An image forming apparatus according to claim 29, wherein, when the first step is being performed, a rotational peripheral velocity of the charging roller is higher than a rotational peripheral velocity of the image bearing member.

31. An image forming apparatus according to claim 17, further comprising a replaceable developer container configured to contain the developer to be supplied to the developer bearing member, wherein the control portion is configured to perform the first step and the second step based on replacement of the developer container.

32. An image forming apparatus according to claim 1, wherein the developer, the polarity of which is inverted from the reversed polarity to the normal polarity in the first step, is attached to the surface of the image bearing member.

33. An image forming apparatus according to claim 1, wherein the developer is one-component toner.

34. An image forming apparatus according to claim 33, wherein the developer is magnetic toner.

35. An image forming apparatus according to claim 1, wherein the cleaning operation is performed in non-image formation periods.

36. An image forming apparatus according to claim 17, wherein the developer is one-component toner.

37. An image forming apparatus according to claim 36, wherein the developer is magnetic toner.

38. An image forming apparatus according to claim 17, wherein the first step is performed in non-image formation periods.

39. An image forming apparatus according to claim 38, wherein the second step is performed in the non-image formation periods.

* * * * *